US005131340A

United States Patent [19]

Tajima et al.

[11] Patent Number: 5,131,340

[45] Date of Patent: Jul. 21, 1992

[54] SELECTIVE THREAD CUTTING DEVICE IN A SEWING MACHINE

[75] Inventors: Ikuo Tajima; Tomoaki Anezaki; Masayoshi Hirate, all of Kasugai, Japan

[73] Assignee: Tokai Kogyo Mishin Kabushiki Kaisha, Kasugai, Japan

[21] Appl. No.: 533,117

[22] Filed: Jun. 4, 1990

[30] Foreign Application Priority Data

Jun. 9, 1989 [JP] Japan ..... 1-67697[U]
Jul. 25, 1989 [JP] Japan ..... 1-87200[U]

[51] Int. Cl.[5] ..... D05B 65/02

[52] U.S. Cl. ..... 112/292; 112/298; 112/295

[58] Field of Search ..... 112/285, 291, 292, 296, 112/297, 298

[56] References Cited

U.S. PATENT DOCUMENTS

| | | | |
|---|---|---|---|
| 1,879,173 | 9/1932 | Gail | 112/285 |
| 3,181,490 | 5/1965 | Kawasaki | 112/292 |
| 3,386,402 | 6/1968 | Ross | 112/292 |
| 3,424,116 | 1/1969 | Von Hagen | 112/298 |
| 4,077,342 | 3/1978 | Steckenrider | 112/297 |
| 4,630,559 | 12/1986 | Kinoshita | 112/291 |

FOREIGN PATENT DOCUMENTS

| | | | |
|---|---|---|---|
| 1068083 | 4/1986 | Japan | 112/285 |
| 1226092 | 10/1986 | Japan | 112/285 |
| 2049896 | 3/1987 | Japan | 112/285 |
| 2053700 | 3/1987 | Japan | 112/285 |
| 3272391 | 11/1988 | Japan | 112/292 |
| 2031793 | 2/1990 | Japan | 112/285 |

*Primary Examiner*—Werner H. Schroeder
*Assistant Examiner*—Ismael Izaguirre
*Attorney, Agent, or Firm*—Dennison, Meserole, Pollack & Scheiner

[57] ABSTRACT

A thread cutting device includes a movable knife positioned below a throat plate and movable from a first position to a thread cutting position via a second position for separating the upper fabric thread and the upper needle thread from each other within the range where the movable knife may engage the upper fabric thread and the upper needle thread but may not engage or cut the lower thread. The movable knife includes an engaging portion for engagement with the upper needle thread on the side toward the second position and a cutting edge on the opposite side. The movable knife also includes a thread separating portion for separation of the upper fabric thread and the upper needle thread between the needle hole and the bobbin holder from each other toward the cutting edge and the engaging portion, respectively, when the movable knife moves from the first position to the second position. A fixed knife is positioned below the throat plate for cooperation with the movable knife at the thread cutting position, so that the upper fabric thread can be cut when the movable knife is moved from the second posiiton to the cutting position. A lower thread guide is positioned below the throat plate and operable to selectively move the lower thread existing between the needle hole and the bobbin holder within the range where the movable knife passes when the movable knife moves from the second position to the cutting position, thereby permitting cutting of both the upper fabric thread and the lower thread.

5 Claims, 9 Drawing Sheets

SELECTIVE THREAD CUTTING DEVICE IN A SEWING MACHINE

CROSS-REFERENCE TO RELATED APPLICATIONS

This application claims the priority of Japanese Application No. 1 67 697 filed Jun. 9, 1989 and Application No. 1 87 200 filed Jul. 25, 1989, which are incorporated herein by reference.

BACKGROUND OF THE INVENTION

1. FIELD OF THE INVENTION

The present invention relates to a thread cutting device in a stitch forming machine which forms a chain of stitches on a fabric by using a lower thread supplied from a bobbin holder positioned below a needle hole of a throat plate and an upper thread supplied from a needle reciprocally vertically moving toward and against the bobbin holder through the needle hole.

2. DESCRIPTION OF THE RELATED ART

One of the conventional thread cutting devices is shown in FIG. 17 which includes a fixed knife C disposed below and adjacent a needle hole B of a throat plate A and a movable knife D for cutting a thread E located between a bobbin holder (not shown) and the needle hole B.

The thread cutting device of this type is particularly applied to a multi-color embroidery machine which is normally provided with a plurality of needle bars. Through each needle bar, an upper thread of different color is threaded and a chain of stitches of different color may be formed by selectively reciprocating one of the needle bars. Normally in this embroidery machine, only the upper thread is cut when the color is to be changed in the case that a pattern with multiple color is embroidered, while both the upper thread and the lower thread are cut when the whole pattern has been embroidered.

Means for selectively effecting the cutting only of the upper thread and the cutting of both the upper thread and the lower thread is disclosed in Japanese Laid-Open Pat. Publication Nos. 63-9487 and 63- 115592. These publications propose the provision of a lower thread sweeping lever which moves across the area below the needle hole for sweeping the lower thread to the position where the movable knife does not act on it, and an upper thread engaging lever which separates the upper needle thread and the upper fabric thread from each other and moves the upper needle thread to the area where the movable knife does not act on it, so that only the upper fabric thread (including the lower thread if it is not swept by the lower thread sweeping lever) may be cut by the movable knife.

In place of using the upper thread engaging lever, it is also proposed that the movable knife itself interposes between the upper fabric thread (including the lower thread if it is not swept by the lower thread sweeping lever) and the upper needle thread so as to separate them from each other prior to reaching the cutting position.

Thus, the conventional thread cutting device is constructed essentially to cut both the upper fabric thread and the lower thread, and the lower thread is moved away when it is not desired to be cut.

However, as described above, in this kind of the switch forming machine, only the upper fabric thread is cut when the color is to be changed in the case that a pattern with multiple color is embroidered, while both the upper fabric thread and the lower thread are cut when a whole pattern has been embroidered. Therefore, the frequency of cutting of only the upper fabric thread is higher than that of the cutting of both the upper fabric thread and the lower thread. Thus, the conventional thread cutting device is disadvantageous in that the lower thread sweeping lever must be frequently moved.

Further, although the lower thread sweeping lever moves across the area below the needle hole, it must not interfere with the upper needle thread which also passes through the needle hole. Therefore, the conventional thread cutting device is further disadvantageous in that the space for mounting the lower thread sweeping lever is very limited and that the lower thread sweeping lever must be moved in a large stroke, so that the thread cutting device must be of large size.

Returning to FIG. 17, in the conventional thread cutting device, the fixed knife C includes at the bottom thereof a cutting edge C1 of substantially right angle. The cutting edge C1 is positioned at one end of the bottom opposite to the direction toward the cutting position of the movable knife D indicated by an arrow. The movable knife D includes at one end thereof toward the cutting position an engaging portion D1 for engagement with the thread E and includes at an opposite end a cutting edge D2. As the movable knife moves toward the cutting position, the thread E extending downwardly toward the bobbin holder is engaged by the engaging portion D1 and is thereafter cut by the cooperation of the cutting edge D2 of the movable knife D with the cutting edge C1 of the fixed knife C. The lower portion E1 of the cut thread E is hold between the bottom of the movable knife D and a leaf spring F for a subsequent stitch forming operation.

In this thread cutting device, as the movable knife D moves in the direction indicated by the arrow, the engaging portion D1 firstly goes under the fixed knife C, so that the thread E between the engaging portion D1 and the needle hole B contacts the cutting edge C1 of the fixed knife C. Therefore, if the tension applied to the thread E becomes larger (particularly in the case that thread E is a lower thread), the thread E may be accidentally worn out at the cutting edge C1 and cut before the cutting edge D2 of the movable knife D cooperates with the cutting edge C1 of the fixed knife C. Thus, the length of the cut lower portion E1 becomes shorter to the extent that it cannot be held by the leaf spring F, causing difficulties in the subsequent stitch forming operation.

SUMMARY OF THE INVENTION

It is, accordingly, an object of the present invention to provide a thread cutting device in a stitch forming machine which may normally cut only an upper fabric thread to be frequently cut and may cut both the upper fabric thread and a lower thread by a simple converting operation so as to improve the operability.

It is another object of the present invention to provide a thread cutting device in a stitch forming machine in which means for converting a thread or threads to be cut may be installed with a large degree of freedom, so that a space below a throat plate can be effectively used and the whole construction of the device becomes simple.

It is a further object of the present invention to provide a thread cutting device in a stitch forming machine in which a thread or threads may be cut always at a predetermined position through the cooperation of a movable knife and a fixed knife so that the thread or threads can be cut to a predetermined length and the subsequent sewing operation can be smoothly started.

According to the present invention, there is provided a thread cutting device in a stitch forming machine which forms a chain of stitches by using a lower thread supplied from a bobbin holder positioned below a throat plate and an upper thread supplied from a needle reciprocally vertically moving toward and against the bobbin holder through the needle hole, comprising:

a movable knife positioned below the throat plate and movable from a first position to the thread cutting position through a second position for separating the upper fabric thread and the upper needle thread from each other within the range where the movable knife may engage the upper fabric thread and the upper needle thread but may not engage or cut the lower thread, the movable knife including an engaging portion for engagement with the upper needle thread on the side toward the second position and a cutting edge on the opposite side and also including a thread separating portion for separation of the upper fabric thread and said upper needle thread between the needle hole and the bobbin holder from each other toward the cutting edge and the engaging portion, respectively, when the movable knife moves from the first position to the second position;

a fixed knife positioned below the throat plate for cooperation with the movable knife at the thread cutting position, so that the upper fabric thread can be cut when the movable knife is moved from the second position to the cutting position; and lower thread guide means positioned below the throat plate and operable to selectively move the lower thread existing between the needle hole and the bobbin holder within the range where the movable knife passes when the movable knife moves from the second position to the cutting position, thereby permitting cutting of both the upper fabric thread and the lower thread.

The lower thread guide means includes a lower thread guide lever pivotally mounted on the bottom of the throat plate in substantially parallel relation thereto and an actuator for moving the lower thread guide lever.

The actuator is a solenoid having a reciprocally and telescopically movable shaft. The device further includes lever means for converting the movement of the shaft into swinging movement of the lower thread guide lever.

The movable knife crosses under and coacts with said fixed knife at the cutting position and includes a second engaging portion engageable with the thread or threads to be cut at the end thereof in the direction of the cutting position. The second engaging portion is positioned not to contact the fixed knife during the movement of the movable knife toward the cutting position. The cutting edge of the movable knife is positioned away from the second engaging portion in the direction opposite to the cutting position. The fixed knife is provided with a cutting edge at the end opposite to the direction toward the cutting position of the movable knife, so that the thread or threads to be cut extends between the cutting edge of the fixed knife and the second engaging portion of the movable knife without contacting the cutting edge of the movable knife before the movable knife reaches the cutting position. Further, between the movable knife and the throat plate, means is provided for adjusting the crooked or deviated angle of the thread or threads at the cutting edge of the fixed knife to a relatively small angle, so that the thread or threads to be cut can be prevented from accidentally being cut before the movable knife cooperates with the fixed knife.

The means for adjusting the deviated angle is a member mounted on the cutting edge of the fixed knife and extending in the direction opposite to the direction toward the cutting position. The member is rounded at the end thereof.

The invention will become more fully apparent from the claims and the description as it proceeds in connection with the drawings.

DETAILED DESCRIPTION OF THE PREFERRED EMBODIMENT

Figure 1:
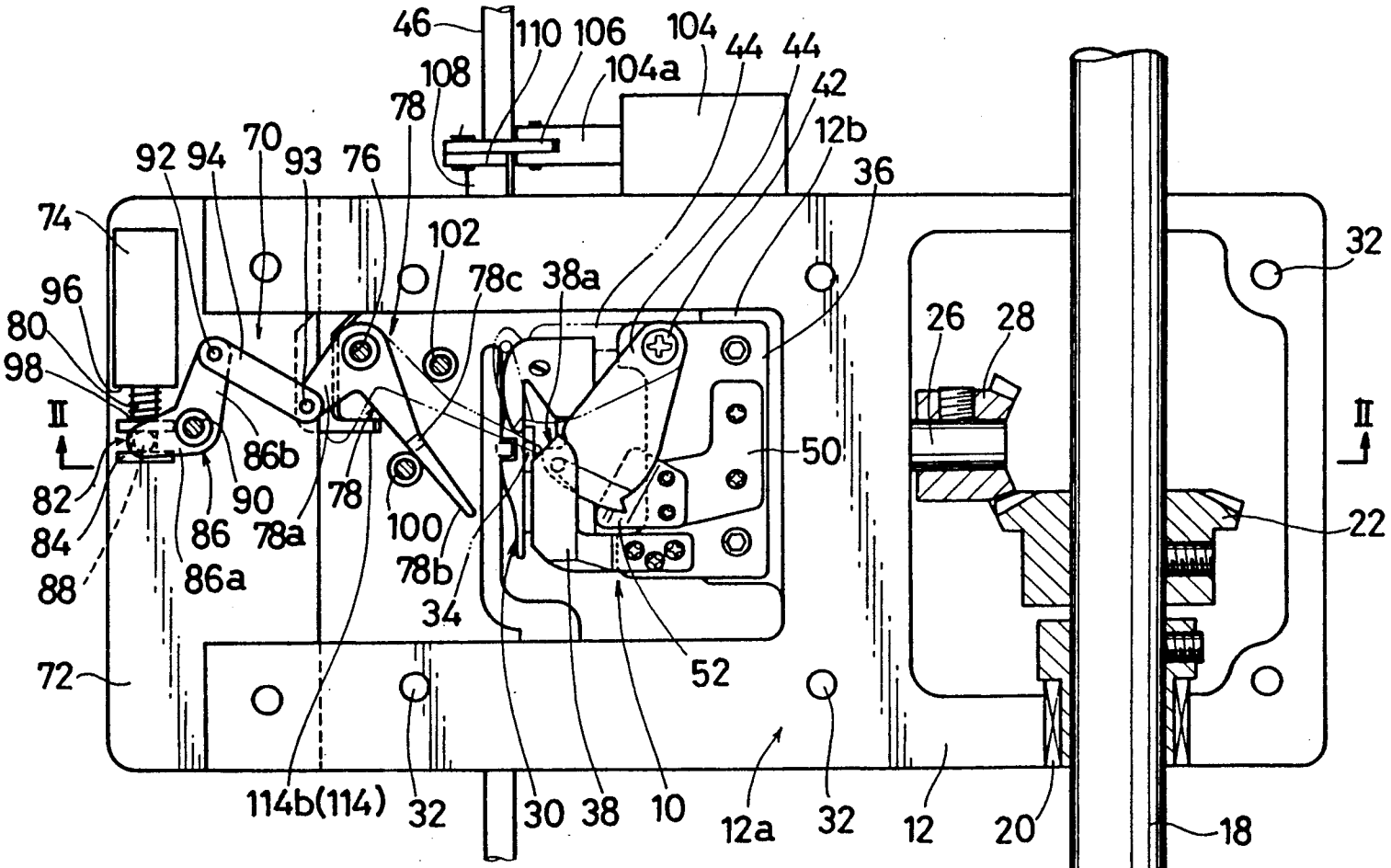
FIG. 1 is a plan view of a stitch forming machine including a thread cutting device according to the present invention.

Rererring to FIG. 1, there is shown in plan view a stitch forming machine including a thread cutting device according to the present invention. The thread cutting device includes a cutting mechanism 10. A shown in FIGS. 1 and 2, a base 12 is fixed to a stationary structure B through threaded shafts 14 and nuts 16 (see FIG. 2) engaging therewith to permit adjustment of the height. A main shaft 18 of the stitch forming machines extends through the base 12 and is rotatably supported by the base 12 by means of a bearing 20 (see FIG. 1). A bevel gear 22 is fixedly mounted on the main shaft 18. The bevel gear 22 engages a bevel gear 28 fixed to the rear end of a hook shaft 26 which is rotatably mounted on the central portion of the base 12 and which extends perpendicular to the main shaft 18. A bobbin holder 30 includes a case holder 30*a* and a rotary hook 30*b* and is mounted on the forward end of the hook shaft 26. The rotation of the main shaft 18 is transmitted to the hook shaft 26 through the bevel gears 22, 28, so that the rotary hook 30*b* is rotated. The case holder 30 *a* includes a lower thread guide 30*c* (see FIG. 2) for guiding a lower thread supplied from a bobbin as will be hereinafter described.

The base 12 has a flat upper surface 12*a* on which a throat plate 13 is secured by screws (threaded holes 32 for engagement with the screws are shown in FIG. 1). The throat plate 13 as a needle hole 34 at a predetermined position above the bobbin holder 30 (see FIG. 2).

Figure 2:
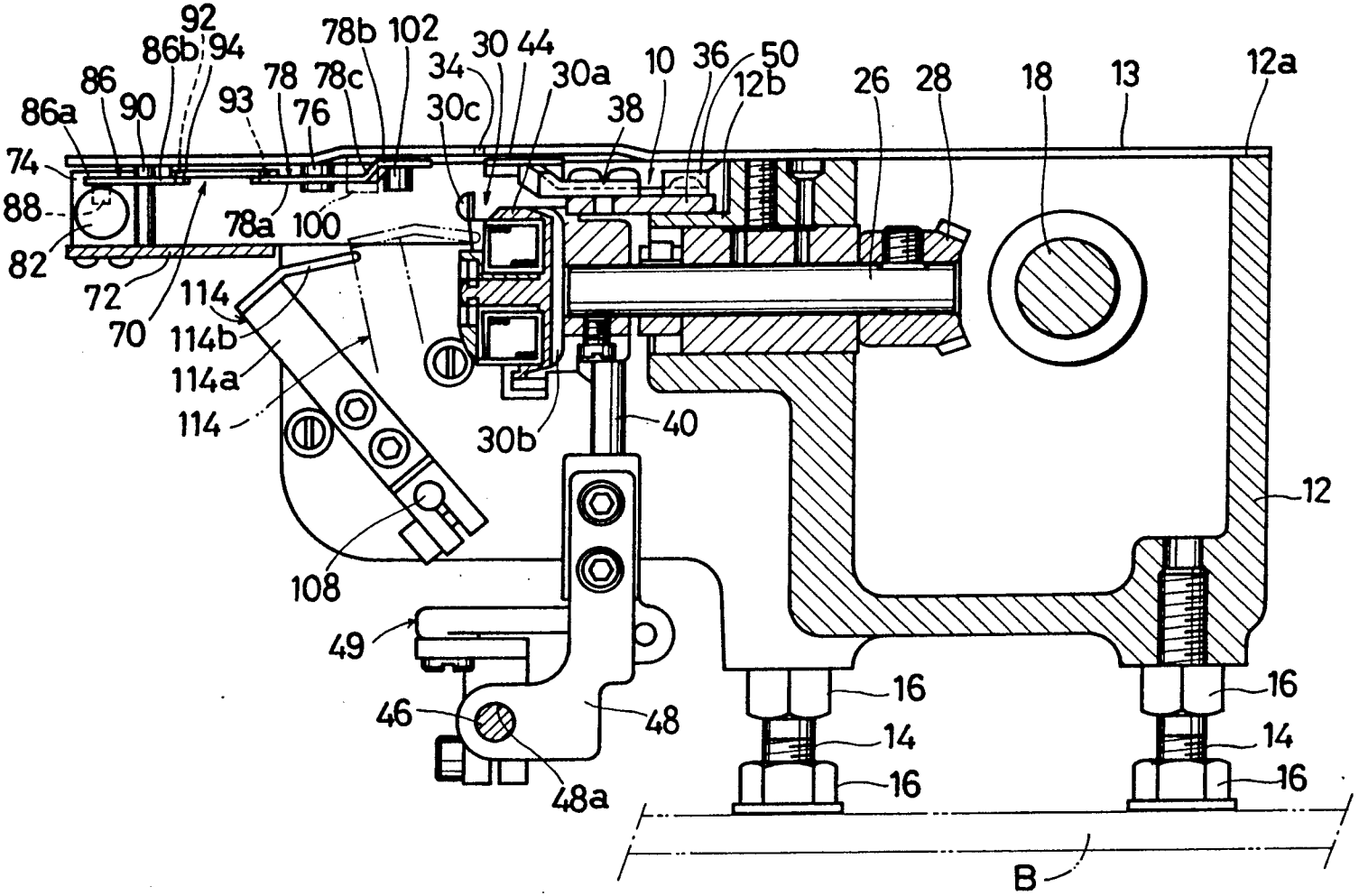
FIG. 2 is a sectional view taken along the line II—II of FIG. 1.

As shown in FIG. 2, the cutting mechanism 10 is positioned rearwardly of the needle hole 34 and immediately below the throat plate 13. The cutting mechanism 10 includes a fixed knife 38 secured to a horizontal plate 36 which is also secured to a middle bottom portion 12*b* of the base 12. The cutting mechanism 10 also includes a movable knife 44 secured to a pivotal shaft 40 by a screw 42. The pivotal shaft 40 extends perpendicular to the horizontal plate 36.

The pivotal shaft 40 is connected with a reciprocating shaft 46 which extends parallel to the main shaft 18 below the forward portion of the base 12. The reciprocating shaft 46 extends through a bore 48*a* formed in a bracket 48 secured to the base 12 (FIG. 2). A link mechanism 49 is interconnected between the pivotal shaft 40 and the reciprocating shaft 46 for converting the linear reciprocating movement of the reciprocating shaft 46 into the reciprocating pivotal movement of the pivotal shaft 40. The detailed explanation of the link mechanism 49 is omitted as such mechanisms for converting the linear reciprocating movement into the reciprocating pivotal movement are well known in the art.

A leaf spring 52 is mounted on the horizontal plate 36 through a bracket 50. As will be hereinafter explained, the leaf spring 52 serves to hold a thread after it has been cut.

Figure 3:
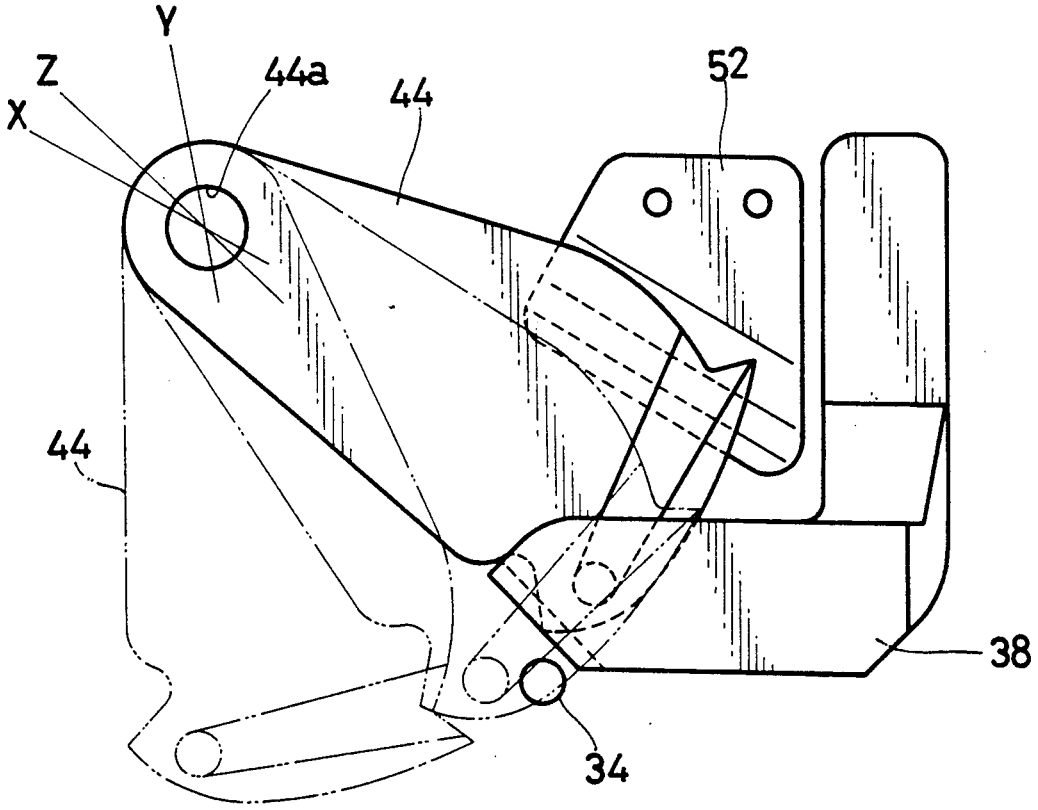
FIG. 3 is an enlarged view of a part of the thread cutting device shown in FIG. 1 at different positions.

As the pivotal shaft 40 reciprocally pivots, the movable knife 44 is moved or swung between a waiting position (a first position) where the forward end of the movable knife 44 is positioned below the forward end of the fixed knife 38 (the position X shown in a solid line in FIG. 3) and a pivoted position (a second position) away from the fixed knife 38 (the position Y shown in a chain line in FIG. 3). Thus, the movable knife 44 moves from the waiting position or the first position to the pivoted position or the second position when the pivotal shaft 40 pivots in one direction, while it moves from the pivoted position to the waiting position when the pivotal shaft 40 pivots in the opposite direction.

Figure 4:
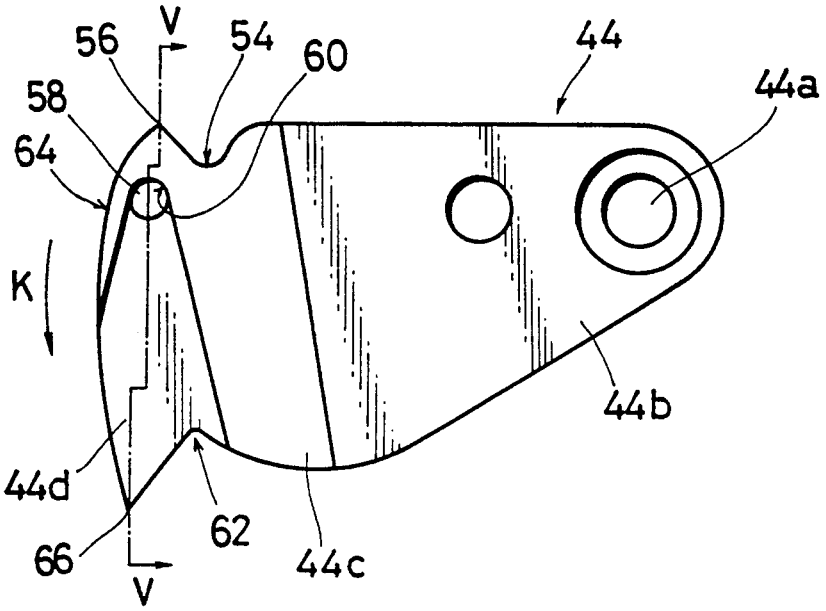
FIG. 4 is an enlarge view of a movable knife of the thread cutting device shown in FIG. 1.
Figure 5:
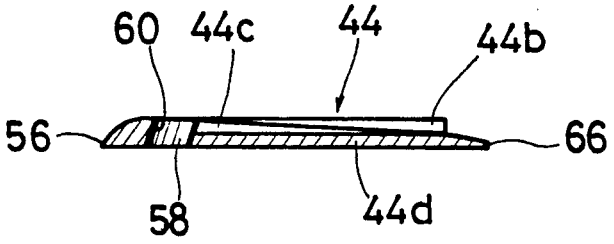
FIG. 5 is a sectional view taken along the line V—V in FIG. 4.

The construction of the movable knife 44 will be hereinafter explained with reference to FIGS. 3 and 4. The movable knife 44 has increased width and includes, successively in the radial direction from a hole 44*a* for insertion of the screw 42 (FIG. 1), a flat base portion 44*b* having the hole 44*a*, a slant portion 44*c* inclined downwardly toward one of the pivotal directions of the movable knife 44 (the direction shown in FIG. 4 by an arrow K) and a flat end portion 44*d*, the upper surface of which is level with the lower end of the slant portion 44*c* (see FIG. 5). The slant portion 44*c* includes a first thread engaging notch 54 of substantially V-shaped configuration formed at the opposite side against the direction of the arrow K in FIG. 4. The slant portion 44*c* is curved toward the end portion 44*d* at the same side as the first thread engaging notch 54 and forms an upper thread separation end 56 projecting in the opposite direction of the arrow K and joined to the first thread engaging notch 54. A through-hole 58 is provided at the opposite side of the curved portion against the upper thread separation end 56 to form a cutting edge 60 in the direction of the arrow K in cooperation with the curved portion. A second thread engaging notch 62 of substantially V-shaped configuration is formed at the side of the end portion 44*d* in the direction of the arrow K. A guide surface 64 of substantially circular arc shape is formed at the outer end of the movable knife 44 in the radial direction. The position of the end 66 of the guide surface 64 in the direction of the arrow K is remotest from the center of the hole 44*a* or the center of pivotal movement of the movable knife 44.

The size of the movable knife 44 is so determined that among an upper needle thread portion, an upper fabric thread and a lower thread, the upper needle thread portion and the upper fabric thread portion are positioned within the range such that the end 66 moves between the waiting position or the first position and the pivoted position or the second position with the movable knife 44 and that the upper thread separation end 56 is interposed between the upper needle thread portion and the upper fabric thread portion when the movable knife 44 moves from the waiting position to the pivoted position. Further, the movable knife 44 is positioned not to interfere with the lower thread.

Figure 6:
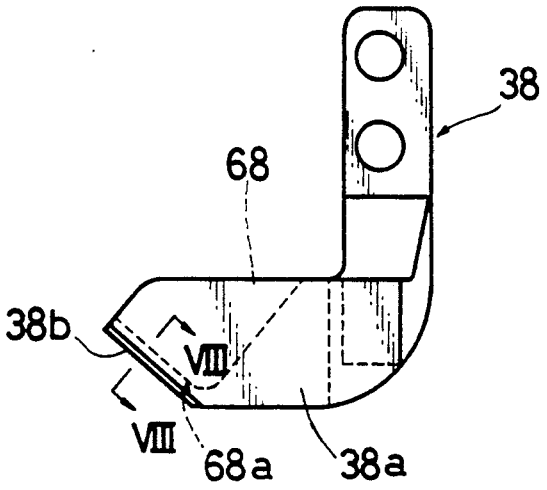
FIG. 6 is an enlarged view of a fixed knife of the thread cutting device shown in FIG. 1.
Figure 7:
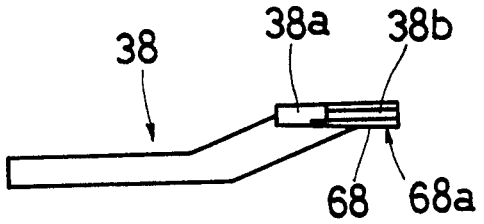
FIG. 7 is a left side view of FIG. 6.
Figure 8:
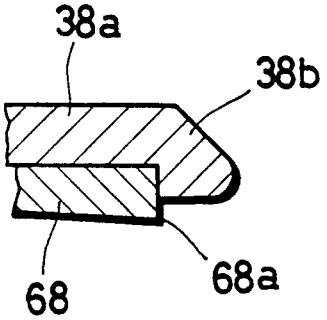
FIG. 8 is a sectional view taken along the line VIII—VIII in FIG. 6.

As shown in FIGS. 6 and 7, the fixed knife 38 includes a L-shaped end portion 38*a* on the bottom surface of which an ultra-hard chip 68 is mounted. The ultra-hard chip 68 forms a cutting edge 68*a* which extends along the straight line drawn from the center of rotation of the movable knife 44. The cutting edge 68*a* is formed substantially at right angles in section as shown in FIG. 8. A member 38*b* for preventing an accidental cut of the thread or threads is formed integrally with the end portion 38*a* of the fixed knife 38 as is most clearly shown in FIG. 8. The member 38*b* is positioned above the cutting edge 68*a* and outwardly extends in parallel with the cutting edge 68*a*. The extremity of the member 38*b* is rounded.

The reciprocating shaft 46 for swinging the movable knife 44 against the fixed knife 38 is driven by drive means (not shown) based on a thread cutting signal from control means (not shown). The control of the movable knife 44 based on the thread cutting signal will be hereinafter explained.

As shown in FIG. 1, a lower thread guide mechanism 70 is positioned forwardly and laterally of the needle hole 34 and below the throat plate 13. The lower thread guide mechanism 70 includes a solenoid 74 screwed on a support plate 72 which is mounted on the forward end of the base plate 12 and is separated from the base plate 12 downwardly therefrom at a suitable distance. The lower thread guide mechanism 70 also includes a lower thread guide lever 78 pivotally mounted on a shaft 76 which is fixed to the bottom of the throat plate 13 at a position rearwardly of the solenoid 74. A guide member 84 is mounted on the end of a shaft 80 of the solenoid 74. The guide member 84 has a guide groove 82 in the direction perpendicular to the shaft 80. A first lever 86 is positioned adjacent rearwardly of the shaft 80 of the solenoid 74. The first lever 86 includes a first arm 86*a* having at its end a pin 88 which projects into the guide groove 82. Further, the first lever 86 is pivotally mounted on a shaft 90 which is fixed to the bottom of the throat plate 13. A second arm 86*b* of the first lever 86 is pivotally connected to one end of a second lever 94 through a pin 92. The other end of the second lever 94 is also pivotally connected to an arm 78*a* of the lower thread guide lever 78 through a pin 93.

The shaft 80 of the solenoid 74 is biased toward the direction away from the solenoid 74 by a spring 98 interposed between the guide member 84 and a side 96 of the body of the solenoid 74 opposite to the guide member 84. When the solenoid 74 is not excited, another arm 78*b* of the lower thread guide lever 78 abuts on a stopper 100 mounted on the bottom of the throat plate 13 so that the lower thread guide lever maintains its position (hereinafter called non-cutting position) shown in FIG. 1.

When the solenoid 74 is excited, the shaft 80 is retracted against the force of the spring 98, so that the first lever 86 is pivoted in a clockwise direction in FIG. 1, the second lever 94 is moved rearwardly and consequently the lower thread guide lever 78 is pivoted in a counterclockwise direction. As the lower thread guide lever 78 pivots, the end portion of the arm 78*b* moves across the position below the needle hole 34. The lower thread guide lever 78 is stopped by a stopper 102 mounted on the bottom of the throat plate 13 at a position beyond the needle hole 34 at a suitable distance (hereinafter called cutting position).

When the lower thread guide lever 78 moves to the cutting position from the non-cutting position across the space below the needle hole 34, the lower thread existing between the needle hole 34 and the bobbin case 30 is moved to within the area through which the movable knife 44, especially the end 66 thereof passes.

The arm 78*b* of the lower thread guide lever 78 includes at a middle position a slant portion 78*c*, and the end portion of the arm 78*b* moves at a different level with the movable knife 44, so that the movable knife 44 and the lower thread guide lever 78 do not interfere with each other.

Further, as shown in FIG. 1, a solenoid 104 having a shaft 104*a* in a longitudinal direction is mounted on the lower side of the base 12. A lever 106 is pivotally connected to the shaft 104*a* at one end and is pivotable perpendicular thereto. As shown in FIG. 2, a pivotal shaft 108 extending perpendicular to the hook shaft 26 is pivotally mounted on the base 12. An arm 110 is fixed to the end of the pivotal shaft 108 at right angles and is pivotally connected to the other end of the lever 106 by means of a pin. As shown in FIG. 2, a picker 114 is mounted on the end of the pivotal shaft 108 inwardly of the base 12. The picker 114 includes an arm portion 114*a* and a hook portion 114*b*. The arm portion 114*a* has a lower end fixed to the pivotal shaft 108 perpendicular thereto. The upper side of the arm portion 114*a* is curved toward the central longitudinal axis of the base 12. The hook portion 114*b* is integrally formed with the upper end of the arm portion 114*b* in a direction parallel to the pivotal shaft 108. The end of the hook portion 114*b* is opposed to the bobbin holder 30 for inserting into the front portion of the case holder 30*a*.

With this construction, when the solenoid is excited by a picker operation signal from the control means, the shaft 104*a* is retracted and the pivotal shaft 108 is pivoted in one direction through the lever 106 and the arm 110, so that the picker 114 is moved from a waiting position shown in a solid line in FIG. 2 to an operable position shown in a chain. When a picker waiting signal is outputted from the control means, the shaft 104*a* is extended and the picker 114 is moved to the waiting position from the operation position. The timing control of such movement of the picker 114 will be explained later. Additionally, the end of the picker 114 is in the form of a slender finger and is inserted into the front portion of the case holder 30*a* at the operable portion shown in FIG. 2.

Figure 9:
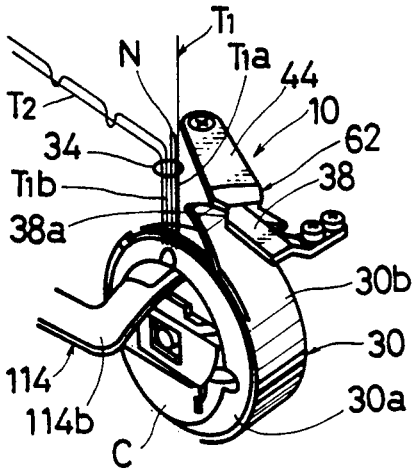
FIG. 9 and 10 are perspective views showing the operation of the thread cutting device and a picker in connection with an upper and a lower thread at different timings, respectively.
Figure 10:
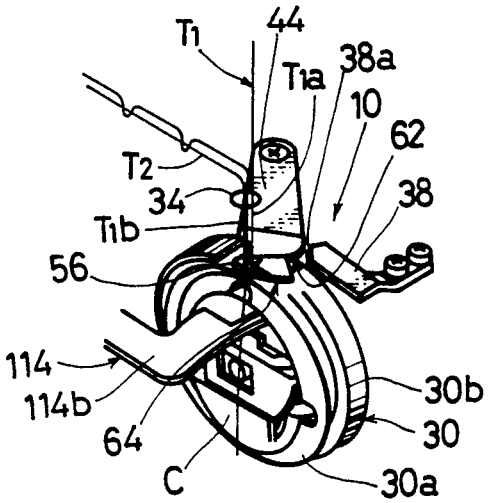

The operation of the present invention will be hereinafter explained in connection with threads of the sewing machine with reference to FIGS. 9 to 15. In FIGS. 9 and 10, the lower thread guide 30*c* is omitted for clearly disclosing the relation between the upper and lower threads T1, T2 and the movable knife 44.

As is well known, a needle N is vertically reciprocated by the main shaft 18 through a well-known power transmission mechanism (not shown), and the upper thread T1 is threaded through the needle N as shown in FIG. 9. The lower thread T2 is supplied from a bobbin (not shown) within the case holder 30*a* of the bobbin case 30. The stitch forming is effected by the upper thread T1 and the lower thread T2 through the vertical reciprocation of the needle N and the rotation of the bobbin case 30.

Figure 11:
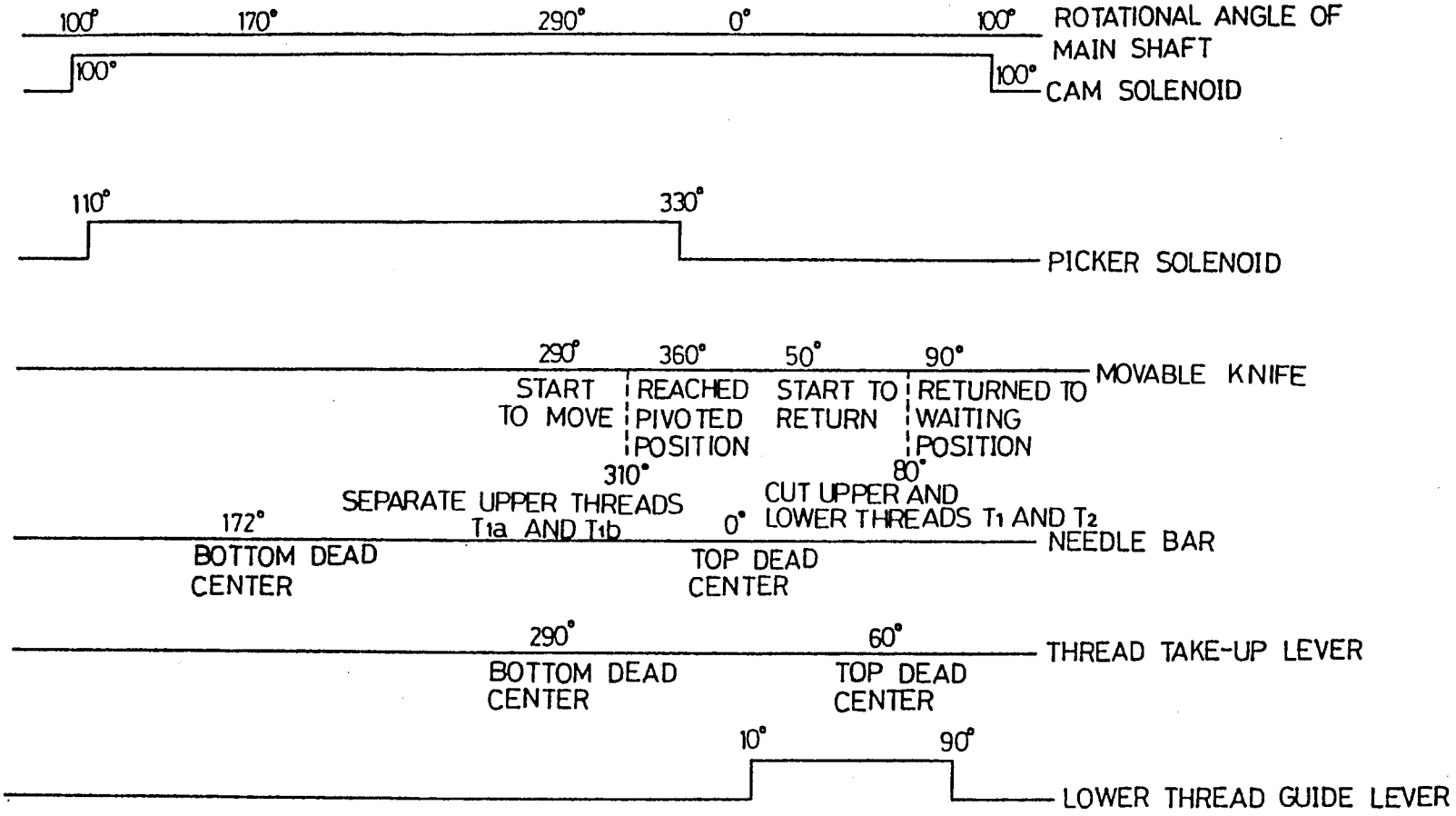
FIG. 11 is a timing chart of the operation of the thread cutting device.

The thread cutting device is operated according to a timing chart shown in FIG. 11.

The timing chart is drawn on the basis of the rotational angle of the main shaft 18 at 100° (the angle hereinafter referred to means the rotational angle of the main shaft 18 unless particularly indicated). When the control means is ordered to cut both the upper thread T1 and the lower thread T2, the control means outputs a thread cutting signal at the angle 100°. Consequently, a cam solenoid (not shown) interconnecting the reciprocating shaft 46 with the drive means is excited, so that the movable knife 44 is pivoted by the reciprocating shaft 46 through a driver cam. As shown in FIG. 11, the movable knife 44 starts to move from the waiting position or the first position to the pivoted position or the second position at the angle 290°.

Meanwhile, the picker operation signal is outputted at the angle 110° and the end of the hook portion 114*b* of the picker 114 is inserted into the front portion of the case holder 30*a*. Such insertion of the hook portion 114*b* is maintained until the main shafts 18 rotates to the angle 330° during which the needle bar (not shown)is moved upwardly from the bottom dead center position, the needle N is withdrawn from the bobbin holder 30 as shown in FIG. 9 and the upper thread T1 passes around the bobbin holder 30 as shown in FIG. 10 corresponding to the angle 310° and the upper thread T1 is partially removed from the bobbin holder 30 at the angle 313°. Thus, by the insertion of the end of the hook portion 114*b* into the case holder 30*a*, the upper thread T1 is engaged by the hook portion 114*b* and is tensioned when it is passing around the bobbin holder 30. This ensures the separating operation of the upper needle thread T1*a* and the upper fabric thread T1*b* by the movable knife 44.

Figure 12:
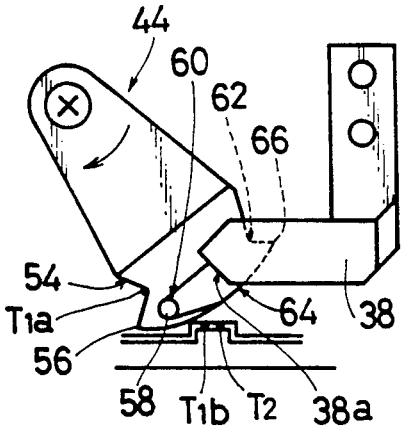
FIG. 12 is a plan view of a part of the thread cutting device showing the operation for separating the threads by the movable knife.
Figure 13:
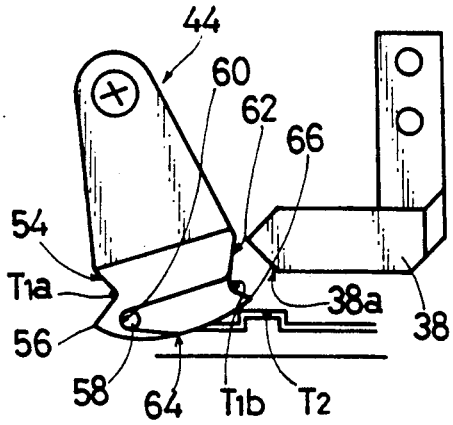
FIG. 13 is a plan view similar to FIG. 12, but showing the relation between the movable knife and the threads after the upper thread has been separated by the movable knife.

The upper thread separation end 56 of the movable knife 44 is interposed between the upper needle thread T1*a* and the upper fabric thread T1*b* as shown in FIG. 10 at the angle 313° when the upper thread T1 is passed halfway around the bobbin holder 30. As the movable knife 44 pivots from this position to the pivoted position or the second position, the upper needle thread T1*a* enters the first thread engaging notch 54 as shown in FIG. 12. The movable knife 44 further pivots until it reaches the pivoted position or the second position at the angle 360° maintaining the engagement of the upper needle thread T1*a* with the first thread engaging notch 54. On the other hand, the upper fabric thread T1*b* is separated by the upper thread separation end 56 toward the guide surface 64 and is slightly moved forwardly by the latter as the movable knife 44 further pivots. As the movable knife 44 further pivots passing under the needle hole 34, the upper fabric thread T1*b* is engaged by the guide surface 64 while the engaged position with the guide surface 64 is guided toward the end 66. The upper fabric thread T1*b* is released from the engagement by the guide surface 64 after passing the end 66 and thereafter the movable knife 44 reaches the pivoted position. The movable knife 44 starts to return to the waiting position or the first position at the angle 50° and at this time, the upper fabric thread T1*b* is engaged by the second thread engaging notch 62 as shown in FIG. 13.

During the movement of the movable knife 44 from the waiting position to the pivoted position, the lower thread T2 between the needle hole 34 and the bobbin holder 30 is maintained out of the range through which the movable knife 44 moves, so that the lower thread T2 is not subjected to the action of the movable knife 44.

It is to be noted that the above interposition by the movable knife 44 between the upper needle thread T1*a* and the upper fabric thread T1*b* is effected before the loop of the upper thread T1 is picked by the picker 114. Therefore, the action of the picker 114 does not have a direct influence on the thread separating operation by the movable knife 44.

Figure 14:
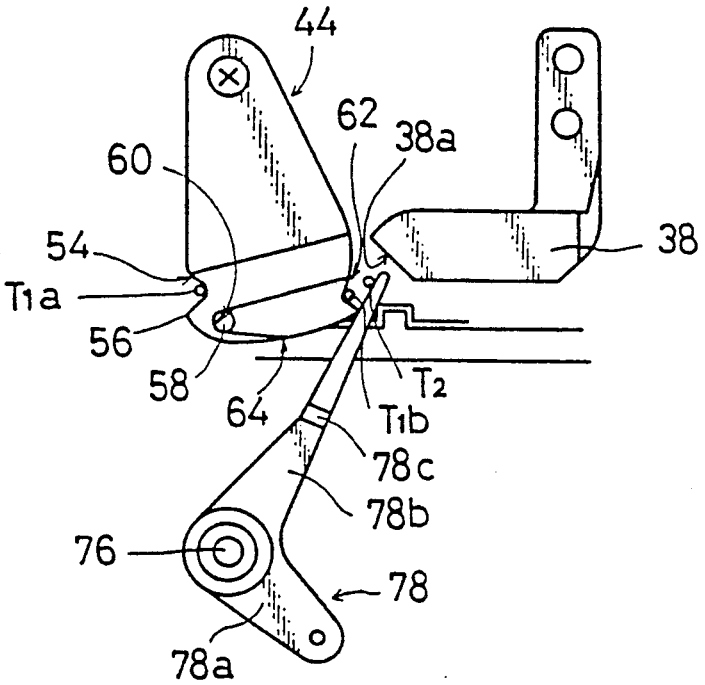
FIG. 14 is a plan view of a part of the thread cutting device showing the operation of a lower thread guide lever which moves the lower thread within a range where the movable knife swings.

In the case that both the upper fabric thread T1*b* and the lower thread T2 are to be cut, the solenoid 74 of the lower thread guide means 70 is excited at the angle 10°, so that the lower thread guide lever 78 is moved to the thread cutting position before the movable knife 44 is pivoted to return to the waiting position at the angle 50°. Thus, the lower thread T2 is moved within the range where the movable knife 44 is pivoted from the pivoted position or second position to the waiting position or the first position as shown in FIG. 14.

When the movable knife 44 is pivoted toward the waiting position, it engages the lower thread T2 as well as the upper fabric thread T1*b* at the second thread engaging notch 62 and thereafter cuts both the lower thread T2 and the upper fabric thread T1*b* in cooperation with the fixed knife 328 at the angle 80°. The movable knife further pivots to return to the waiting position or the first position at the angle 90°.

In the case that the solenoid 74 is not excited, the lower thread guide lever 78 is not pivoted, and the lower thread T2 is not cut.

Figure 15:
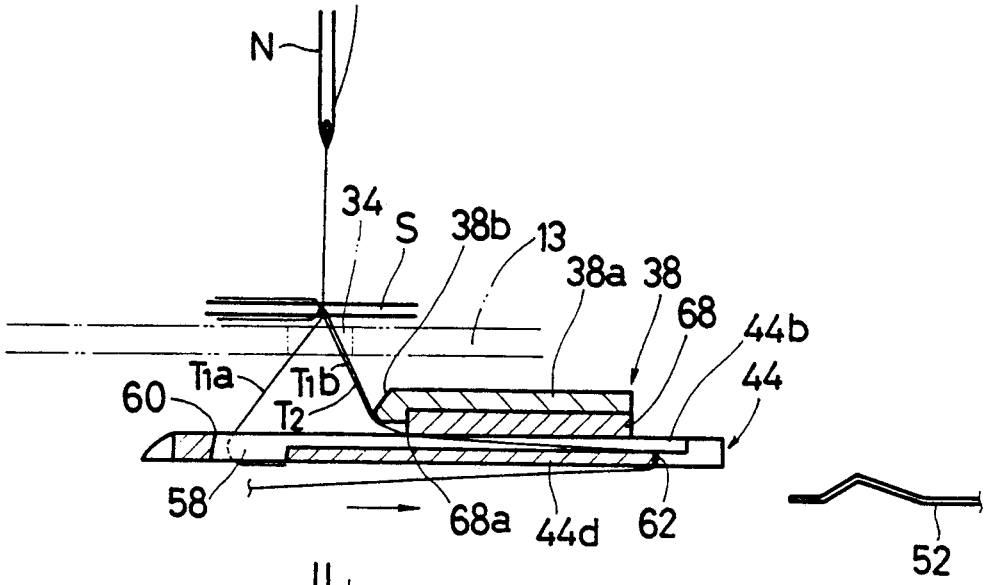
FIGS. 15 and 16 are sectional views of a part of the thread cutting device showing the relation between the movement of the movable knife relative to the fixed knife and the threads to be cut at different positions, respectively.
Figure 16:
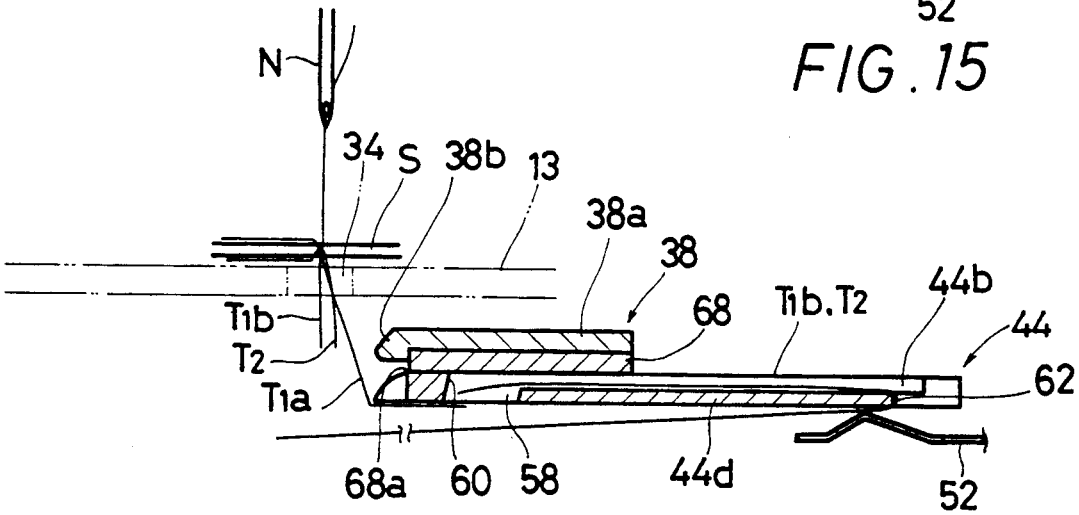
Figure 17:
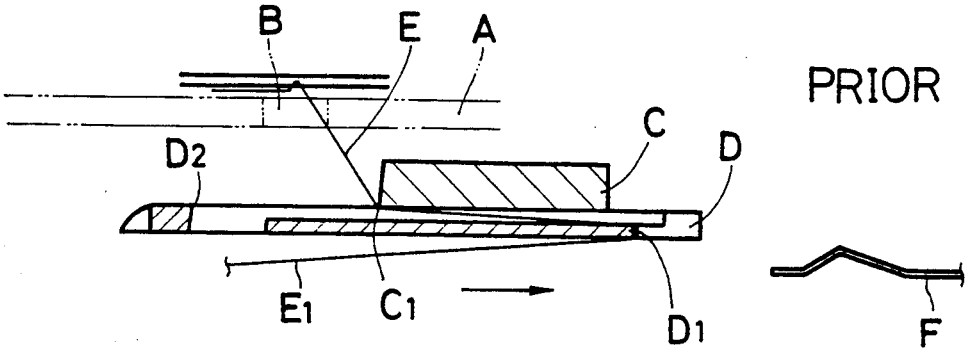
PRIOR ART FIG. 17
FIG. 17 is a sectional view of a part of the thread cutting device according to the prior art.

As previously explained, the member 38*b* for preventing an accidental cut of the thread or threads is formed integrally with the end portion 38*a* of the fixed knife 38 above the cutting edge 68*a* and outwardly extends in parallel to the cutting edge 68*a*. The operation of the member 38*b* will be hereinafter explained in connection with the thread cutting operation with reference to FIGS. 15 and 16. FIGS. 15 and 16 correspond to the operation for cutting both the upper fabric thread T1*b* and the lower thread T2 by the movement of the movable knife 44 from the pivoted position to the waiting position. Specifically, FIG. 15 shows the relation between the movable knife 44 and the fixed knife 38 when the movable knife 44 is at the position Z between the waiting position X and the pivoted position Y, and FIG. 16 shows the relation between the movable knife 44 and the fixed knife 38 at the first position X. In these figures, a fabric S to be sewn is also shown.

As shown in FIG. 15, the movable knife 44 engaging the upper fabric thread T1*b* and the lower thread T2 by the second thread engaging notch 62 moves along the lower surface of the fixed knife 38 in the direction indicated by an arrow. The upper fabric thread T1*b* and the lower thread T2 extending from the fabric S to the second thread engaging notch 62 are firstly engaged by the member 38*b* and subsequently by the cutting edge 68*a* to form crooked or deviated portions and extend between the fixed knife 38 and the movable knife 44 to reach the second thread engaging notch 62. Although the flat base portion 44*b* of the movable knife 44 contacts the bottom of the fixed knife 38 or the bottom of the ultra-hard chip 68, the upper surface of the end portion 44*d* joined to the second thread engaging notch 62 is lower than the upper surface of the base portion 44*b*. Therefore, the upper fabric thread T1*b* and the lower thread T2 are free from being pinched between the movable knife 44 and the fixed knife 38.

In this embodiment, although the upper fabric thread T1*b* and the lower thread T2 contact the cutting edge 68*a* of the fixed knife 38 as the movable knife 44 moves from the pivoted position to the waiting position and the second thread engaging notch 62 goes under the fixed knife 38, the upper fabric thread T1*b* and the lower thread T2 also contact the member 38*b*, so that these threads are crooked or deviated at the cutting edge 68*a* by relatively small angle. Thus, the upper fabric thread T1*b* and the lower thread T2 are prevented from being accidentally cut by the cutting edge 68*a* when the movable knife 44 moves in the direction indicated by the arrow in FIG. 15 tensioning the threads between the fabric S and the second thread engaging notch 62.

The movable knife 44 further moves in the direction indicated by the arrow in FIG. 15 to cut the upper fabric thread T1*b* and the lower thread T2 through the cooperation of the cutting edge 60 of the movable knife 44 with the cutting edge 68*a* of the fixed knife 38. The movable knife 44 thereafter reaches the waiting position as shown in FIG. 16. The movable knife 55 is formed with relatively large width in such a manner that the distance becomes long between the cutting point of the cutting edge 60 and the second thread engaging notch 62. Therefore, the length of the needle side portion of the upper fabric thread T1*b* and the bobbin holder side portion of the lower thread T2 which has been cut from their corresponding threads becomes long enough to smoothly start the subsequent operation. Further, as shown in FIG. 11, the movable knife 44 starts to move toward the waiting position at a timing when a thread take-up lever reached around the top dead center. The above noted length of the cut threads T1*b* and T2 becomes further longer by such setting of timing as well as the wide width of the movable knife 44.

Immediately before the movable knife 44 reaches the waiting position, the leaf spring 52 contacts the bottom of the movable knife 44 adjacent the second thread engaging notch 62, so that the needle side portion of the upper fabric thread T1*b* and the bobbin holder side portion of the lower thread T2 are pinched between the leaf spring 52 and the movable knife 44, and are maintained to have the predetermined length suitable for subsequent starting of the sewing operation.

On the other hand, when it is desired to cut only the upper fabric thread t1*b*, the lower thread guide means 70 is maintained at the thread non-cutting position or the solenoid 74 is not excited. The other operation is the same as the case of cutting both the upper fabric thread T1*b* and the lower thread T2. Thus, the lower thread T2 is maintained out of the area through which the movable knife 44 is moved, and the movable knife 44 cuts only the upper fabric thread t1*b*.

Further, although in this embodiment the upper fabric thread T1*b* and the lower thread T2 deviate at the cutting edge 68*a* by relatively a small angle by the aid of the member 38*b* integral with the fixed knife 38, such means for deviating at a relatively small angle may be whatever means or parts which can change the path of the thread or threads between the throat plate 13 and the movable knife such as a protrusion mounted on the bottom of the throat plate 13 to contact the thread or threads above the fixed knife 38.

While the invention has been described with reference to the preferred embodiment thereof, it is to be understood that modifications or variations may be easily made without departing from the scope of the present invention which is defined by the appended claims.

What is claimed is:

1. A thread cutting device in a stitch forming machine using a lower thread supplied from a bobbin holder positioned below a needle hole of a throat plate and an upper thread derived from a needle reciprocally vertically moving in and out of the bobbin holder through the needle hole, comprising:

a movable knife positioned below said throat plate, between said needle hole and bobbin holder, and movable to a first, second, and cutting position; said movable knife includes a first thread engaging portion on a side thereof facing in a direction of movement from the first position to the second position, a cutting edge on an opposite side thereof, facing a direction of movement from the second position to the cutting position, and a thread separating portion for separating an upper fabric thread and the upper needle thread from each other by moving the upper needle thread toward said first thread engaging portion and moving said upper fabric thread toward said cutting edge, when said movable knife moves from said first position to said second position;

a fixed knife positioned below said throat plate cooperating with said movable knife at said thread cutting position, for cutting the upper fabric thread when said movable knife is moved from said second position to said cutting position; and lower thread guiding means positioned below said throat plate and selectively operable for moving the lower thread toward said cutting edge for cutting both the upper fabric thread and the lower thread when said movable knife is moved from said second position to said cutting position.

2. The thread cutting device as defined in claim 1 wherein said lower thread guiding means includes a lower thread guide lever pivotally mounted on a bottom surface of said throat plate in substantially parallel relation thereto and an actuator for moving said lower thread guide lever.

3. The thread cutting device as defined in claim 2 wherein said actuator is a solenoid having a reciprocally and telescopically movable shaft and further including lever means for converting the movement of said shaft into a swinging movement of said lower thread guide lever.

4. The thread cutting device as defined in claim 1 wherein said movable knife coacts with said fixed knife at said cutting position, said movable knife further includes a second thread engaging portion, for engaging the thread or threads to be cut, at an end thereof facing in a direction of movement from said second position to said cutting position, said cutting edge of said movable knife is positioned upstream of said second thread engaging portion in said direction of movement, said fixed knife including a cutting edge at an end thereof opposing said direction of movement of the movable knife, a portion of said thread or threads to be cut, engaged by said second thread engaging portions, extends beyond said fixed knife cutting edge and between said fixed knife and said second thread engaging portion when said movable knife is proximate said cutting position, said movable knife with said upstream cutting edge and said fixed knife with said cutting edge, then cutting said thread or threads at said cutting position, and wherein between said movable knife and said throat plate, means is provided for adjusting a deviated angle of the thread or threads at said cutting edge of said fixed knife to a relatively small angle, so that the thread or threads to be cut are prevented from accidentally being cut before said movable knife cooperates with said fixed knife.

5. The thread cutting device as defined in claim 4 wherein said means for adjusting the deviated angle is a member mounted on said cutting edge of said fixed knife and extending in said opposed direction, said member being rounded at an end thereof.

* * * * *